US008851602B2

(12) United States Patent
Zhang

(10) Patent No.: US 8,851,602 B2
(45) Date of Patent: Oct. 7, 2014

(54) LIQUID EJECTING APPARATUS

(75) Inventor: Junhua Zhang, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 273 days.

(21) Appl. No.: 13/422,852

(22) Filed: Mar. 16, 2012

(65) Prior Publication Data

US 2012/0242727 A1 Sep. 27, 2012

(30) Foreign Application Priority Data

Mar. 22, 2011 (JP) ..... 2011-062828

(51) Int. Cl.
*B41J 29/38* (2006.01)
*B41J 2/045* (2006.01)

(52) U.S. Cl.
CPC ..... *B41J 2/04581* (2013.01); *B41J 2/04573* (2013.01); *B41J 2/04588* (2013.01)
USPC ..... 347/10; 347/11

(58) Field of Classification Search
USPC ..... 347/10, 11
See application file for complete search history.

(56) References Cited

U.S. PATENT DOCUMENTS 7,090,323 B2 * 8/2006 Takatsuka ..... 347/17
8,328,309 B2 * 12/2012 Izumi et al. ..... 347/10

FOREIGN PATENT DOCUMENTS

JP 2009-226587 A 10/2009

* cited by examiner

*Primary Examiner* — Julian Huffman
(74) *Attorney, Agent, or Firm* — Kilpatrick Townsend & Stockton LLP

(57) ABSTRACT

A time from a start end of a contraction portion of a first middle dot drive pulse of a first drive signal to a start end of the contraction portion of a second middle dot drive pulse of a second drive signal is set to Tc/2 or more and Tc or less in the same unit period. In addition, a time from a start end of a preliminary portion of a first small dot drive pulse to a start end of a preliminary portion of a second small dot drive pulse is set to Tc or more. Thus, while a piezoelectric vibrator corresponding to the other side of adjacent nozzles is driven by the second drive signal, a piezoelectric vibrator corresponding to one side of adjacent nozzles is driven by the first drive signal.

5 Claims, 6 Drawing Sheets

LIQUID EJECTING APPARATUS

BACKGROUND

1. Technical Field

The present invention relates to a liquid ejecting apparatus such as an ink jet type recording apparatus, in particular to a liquid ejecting apparatus capable of controlling ejection of liquid using a plurality of drive signals.

2. Related Art

A liquid ejecting apparatus is an apparatus that includes a liquid ejecting head capable of ejecting liquid from a nozzle as a liquid droplet and ejects all types of liquid from the liquid ejecting head. As a representative liquid ejecting apparatus, for example, there is an image recording apparatus such as an ink jet type recording apparatus (a printer) that includes an ink jet type recording head (hereinafter, referred to as a recording head) and ejects liquid-phased ink from a nozzle of the recording head as an ink droplet so as to perform recording. In addition, except for that, the liquid ejecting apparatus is used in ejection of various types of liquid such as color material that is used as color filters of a liquid crystal display or the like, organic material that is used as an organic EL (Electro Luminescence) display, and electrode material that is used for forming the electrode or the like. Thus, ink is ejected at the recording head of the image recording apparatus, and a solution of each color material of R (Red)•G (Green)•B (Blue) is ejected at a color material ejecting head of a display manufacturing apparatus. In addition, a liquid-phased electrode material is ejected at an electrode material ejecting head of an electrode forming apparatus and solution of a bioorganic substance is ejected at a bioorganic substance ejecting head of a chip manufacturing apparatus.

The recording head that is mounted on the printer has a configuration such that ink is introduced into a pressure chamber from an ink supply source such as an ink cartridge, a pressure generating unit is actuated and then pressure variation is generated in ink inside the pressure chamber so that ink inside the pressure chamber is ejected as an ink droplet from the nozzle using the pressure variation. In the above-described recording head, a plurality of nozzles is arranged in high density so that image quality enhancement of a recording image corresponds thereto (for example, 300 dpi or more) (see JP-A-2009-226587). Accordingly, an arrangement density of the pressure chambers that communicate with each of the nozzles respectively is also increased.

As described above, in a configuration where the pressure chambers are arranged in high density, a partition that divides adjacent pressure chambers becomes considerably thin. Thus, for example, when ink is ejected from any nozzle, the partition may be bent to the adjacent pressure chamber side according to the pressure variation of ink inside the pressure chamber by driving of a pressure generating unit. Regarding this point, if ejection is also performed at nozzles that are positioned at both sides of the adjacent ejecting nozzles respectively at the same timing, the pressure inside both sides of an adjacent pressure chamber is also increased so that the bending of the partition is capable of being suppressed. However, if ejection is not performed even in any one of both sides of the adjacent nozzles, there is a concern that the partition is bent to the pressure chamber side of non-ejecting nozzles. Thus, if the partition is bent to the adjacent pressure chamber side when the ink droplet is ejected, to that extent loss of pressure is generated with respect to the pressure chamber corresponding to the ejecting nozzle such that there is a concern that change of an ejecting characteristic of the ink droplet such as decreasing of flying speed of the ink droplet or decreasing of amount of the ink droplet may occur.

As described above, in the ejecting nozzles, pressure variation states that are generated inside the pressure chamber are different between when the nozzles both sides of the adjacent ejecting nozzles are driven simultaneously and when the nozzles both sides of the adjacent ejecting nozzle are not driven simultaneously. Accordingly, there is a problem in that the ejecting characteristic is varied at the ejecting nozzles and so-called crosstalk may occur. Recently, there has been a case where the liquid ejecting apparatus that is configured as described above is also used to eject liquid of which the viscosity is 8 mPa·s or more at room temperature (for example, 25° C.) (hereinafter, referred to as high viscosity liquid). Ultraviolet curable ink that is cured by irradiating ultraviolet, liquid crystal or the like is a type of high viscosity liquid. In the case where high viscosity liquid is ejected, the crosstalk tends to easily occur compared to a case where low viscosity liquid of which the viscosity is less than 8 mPa·s at room temperature is ejected.

In addition, such a problem not only occurs at the ink jet type recording apparatus mounted with the recording head that ejects ink but also other liquid ejecting apparatuses where a pressure variation occurs at liquid inside a pressure chamber by deforming an actuation surface so as to eject liquid from a nozzle.

SUMMARY

An advantage of some aspects of the invention is that it provides a liquid ejecting apparatus in which crosstalk is prevented when liquid is ejected so that an ejecting characteristic is capable of constantly being arranged.

According to an aspect of the invention, there is provided a liquid ejecting apparatus including: a liquid ejecting head that has a plurality of nozzles ejecting liquid, a pressure chamber communicating with each of the nozzles respectively and a pressure generating unit generating a pressure variation to liquid inside the pressure chamber, and that ejects liquid from the nozzle by driving of the pressure generating unit; a drive signal generating unit that is capable of generating a plurality of drive signals including drive pulses that drive the pressure generating unit so as to eject liquid, in a predetermined period; and a selection control unit that performs control to selectively apply the drive pulses included in the drive signals that are generated from the drive signal generating unit with respect to the pressure generating unit, wherein the drive signal generating unit generates a first drive signal including a first drive pulse and a second drive signal including a second drive pulse that is generated later than the first drive pulse within the same period, wherein a time from a start end of the first drive pulse to a start end of the second drive pulse is set to an inherent vibration period Tc or more of pressure vibration that is generated in liquid inside the pressure chamber, and wherein the selection control unit applies the first drive pulse with respect to the pressure generating unit corresponding to one side of adjacent nozzles and applies the second drive pulse with respect to the pressure generating unit corresponding to the other side thereof.

According to the aspect of the invention, the time from the start end of the first drive pulse to the start end of the second drive pulse is set to the inherent vibration period Tc or more, the first drive pulse with respect to the pressure generating unit corresponding to one side of the adjacent nozzles is applied and the second drive pulse with respect to the pressure generating unit corresponding to the other side of the adjacent nozzles is applied. Thus, the timing at which the pressure inside the pressure chamber is the highest is capable of being displaced between adjacent nozzles. Accordingly, regardless of the number of nozzles that are driven at the same period, ink is ejected from each of the nozzles in a state near a state where ink is always ejected independently so that variation of the ejecting characteristic is suppressed. As a result, crosstalk between adjacent nozzles may decrease.

According to another aspect of the invention, there is provided a liquid ejecting apparatus including: a liquid ejecting head that has a plurality of nozzles ejecting liquid, a pressure chamber communicating with each of the nozzles respectively and a pressure generating unit generating a pressure variation to liquid inside the pressure chamber, and that ejects liquid from the nozzle by driving of the pressure generating unit; a drive signal generating unit that is capable of generating a plurality of drive signals including drive pulses that drive the pressure generating unit so as to eject liquid, in a predetermined period; and a selection control unit that performs control to selectively apply the drive pulses included in the drive signals that are generated from the drive signal generating unit with respect to the pressure generating unit, wherein the drive signal generating unit generates a first drive signal including a first drive pulse and a second drive signal including a second drive pulse that is generated later than the first drive pulse within the same period, wherein the first drive pulse and the second drive pulse have an expansion element that preliminarily expands the pressure chamber and a contraction element that contracts the pressure chamber expanded by the expansion element respectively so as to eject liquid from the nozzle, wherein a time from a start end of the contraction element of the first drive pulse to a start end of the contraction element of the second drive pulse is set to Tc/2 or more and Tc or less, and wherein the selection control unit applies the first drive pulse with respect to the pressure generating unit corresponding to one side of adjacent nozzles and applies the second drive pulse with respect to the pressure generating unit corresponding to the other side thereof.

According to the aspect of the invention, since the time from the start end of the contraction element of the first drive pulse to the start end of the contraction element of the second drive pulse is set to Tc/2 or more and Tc or less, the timings at which the pressure of liquid inside the pressure chamber is the highest are displaced each other so that the crosstalk is suppressed. In addition, the significant displacement of the landing position on the landing object of liquid that is ejected from each nozzle is decreased. Furthermore, the time from the start end of the contraction element of the first drive pulse to the start end of the contraction element of the second drive pulse is Tc or less so that an unnecessarily long repeat period of the drive signal is decreased.

In addition, it is preferable that the viscosity of liquid is 8 mPa·s or more when liquid is ejected from the nozzle.

In other words, reduction of the vibration of high viscosity ink itself of 8 mPa·s or more is faster than that of low viscosity liquid (less than 8 mPa·s) such that it is possible to more certainly decrease crosstalk.

In addition, it is preferable that a formation pitch of each of the nozzles is 1/300 inch or less.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described based on the accompanying drawings. In the embodiments that are described below, there are various limits as preferred specific examples of the invention, however the range of the invention is not limited to the embodiments as long as the purpose of the description does not specifically limit the invention in the description below. In the following description, as a liquid ejecting apparatus of the invention, an ink jet type recording apparatus (hereinafter referred to as a printer) is taken as an example.

Figure 1:
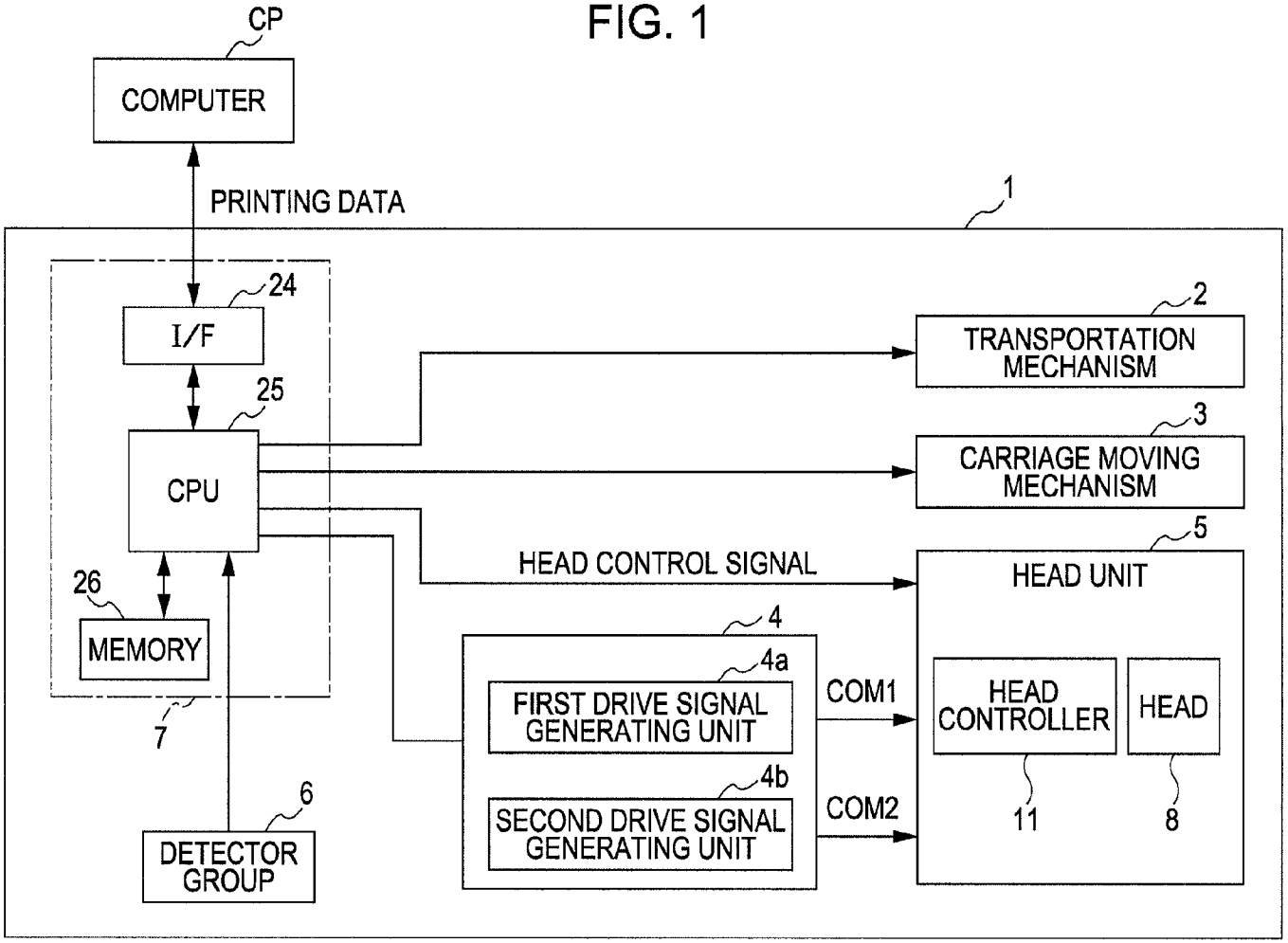
FIG. 1 is a block diagram illustrating an electrical configuration of a printer.
Figure 2:
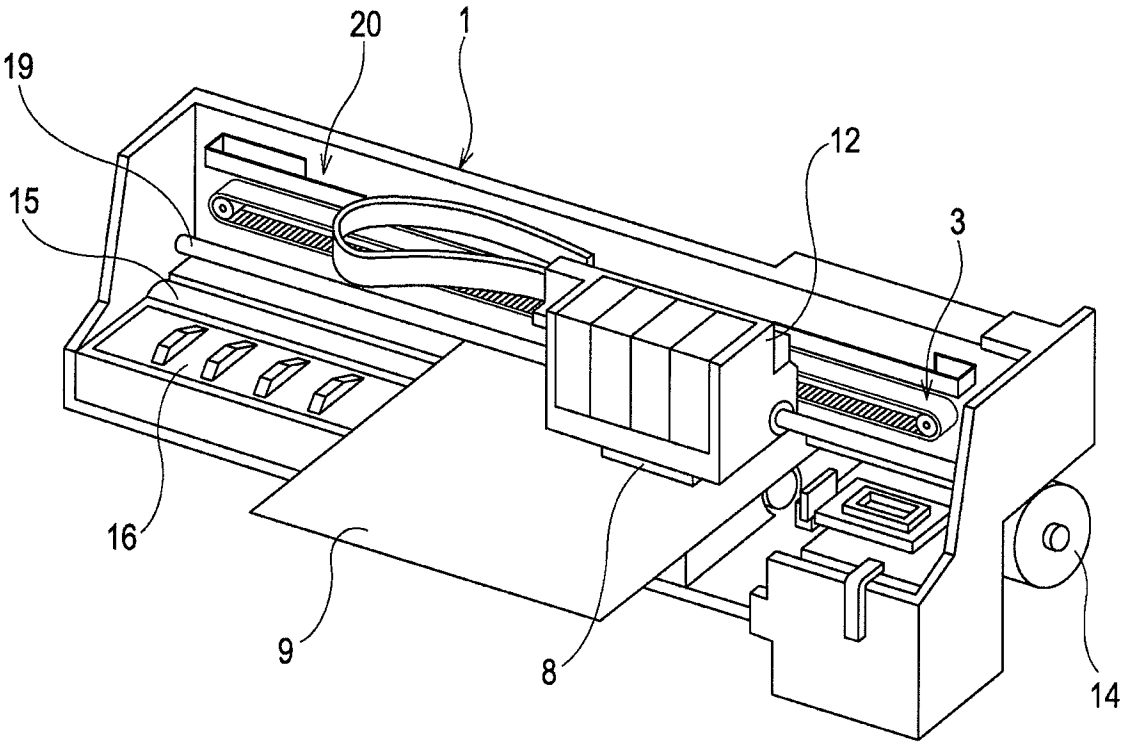
FIG. 2 is a perspective view illustrating an internal configuration of a printer.

FIG. 1 is a block diagram illustrating an electrical configuration of a printer 1. In addition, FIG. 2 is a perspective view illustrating an internal configuration of the printer 1.

The exemplified printer 1 ejects ink that is a type of liquid toward a recording medium 9 (a type of landing object) such as a recording paper, resin film. The recording medium 9 is a type of landing object that is an object on which ejected liquid is landed. A computer CP as an external apparatus is communicably connected to the printer 1. In order to print an image with the printer 1, the computer CP transmits printing data corresponding to the image to the printer 1.

Figure 5:
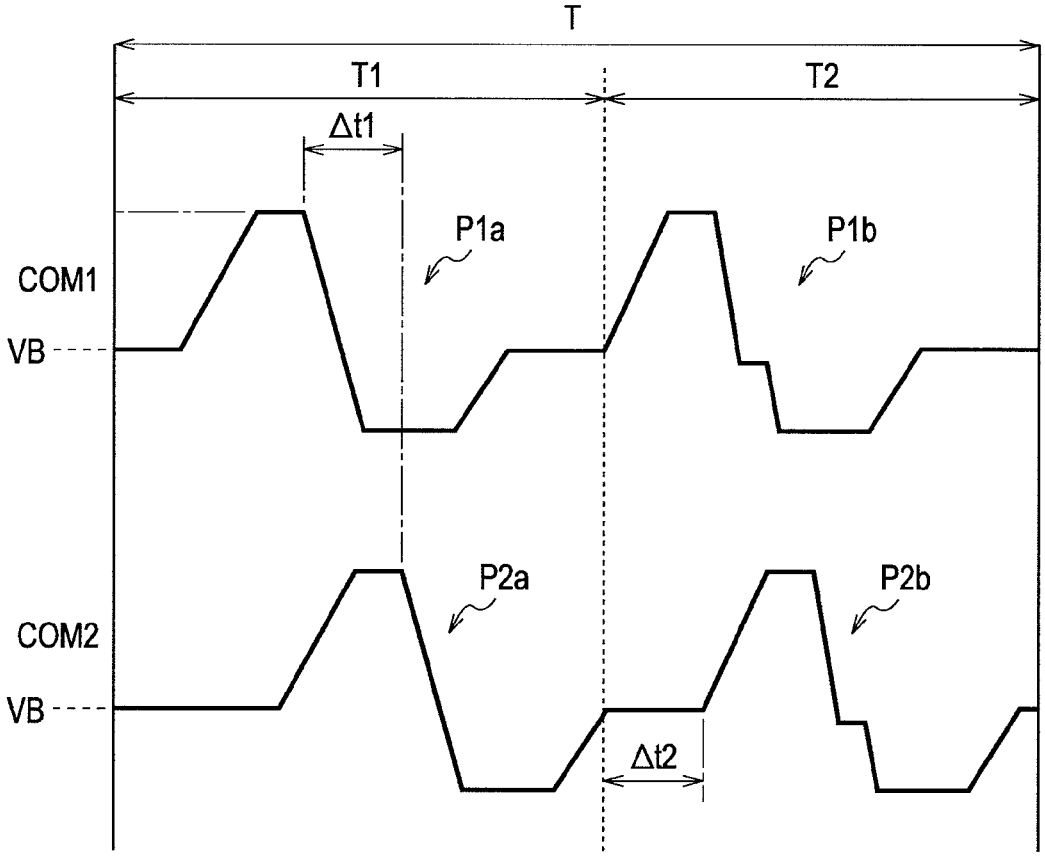
FIG. 5 is a waveform drawing illustrating a configuration of a driving signal.

The printer 1 in the embodiment has a transportation mechanism 2, a carriage moving mechanism 3, a drive signal generating circuit 4 (a type of drive signal generating unit), a head unit 5, a detector group 6 and a printer controller 7. The transportation mechanism 2 transports the recording medium 9 in a transportation direction. The carriage moving mechanism 3 moves the carriage where the head unit 5 is attached in a predetermined movement direction (for example, a width direction of the paper). The drive signal generating circuit 4 generates an analogue voltage signal based on waveform data regarding a waveform of the drive signal transmitted from the printer controller 7. In addition, power is amplified in the voltage signal and a drive signal COM is generated. The drive signal generating circuit 4 in the embodiment has a first drive signal generating unit 4*a* that generates a first drive signal COM1 and a second drive signal generating unit 4*b* that generates a second drive signal COM2. The drive signals COM1 and COM2 are applied to a piezoelectric vibrator 32 (see FIG. 3) of the recording head 8 when a printing process (a type of a recording process or an ejecting process) is performed with respect to the recording medium 9. As an example is shown in FIG. 5, the drive signal is a signal including at least one of drive pulses within a unit period T that is a repeatedly generating period. Here, the drive pulse causes the piezoelectric vibrator 32 to perform a predetermined operation so that ink having a liquid droplet shape is ejected from the recording head 8. In addition, detailed description of the drive signals COM1 and COM2 is given below.

The head unit 5 has the recording head 8 and a head controller 11. The recording head 8 is a type of liquid ejecting head, ejects ink from a nozzle 43 toward the recording medium 9, lands ink at a predetermined area of the recording medium 9 and forms dots. The dots are lined up in a plurality of matrix shapes so that the image and the like are recorded on the recording medium 9. The head controller 11 controls the recording head 8 based on the head control signal from the printer controller 7. In addition, a configuration of the recording head 8 will be described below. The detector group 6 is configured of a plurality of detectors that monitors a situation of the printer 1. The detector group 6 includes a linear encoder 20 described below, a temperature sensor (not shown) that detects the temperature near the recording head 8 and the like.

The transportation mechanism 2 is a mechanism for transporting the recording medium 9 in a direction (a sub-scanning direction) orthogonal to a scanning direction of the recording head 8. The transportation mechanism 2 has a transportation motor 14, a transportation roller 15 and a platen 16. The transportation roller 15 is a roller that transports the recording medium 9 onto the platen 16 that is an area where the recording medium 9 is capable of being printed, and is driven by the transportation motor 14. The platen 16 supports the recording medium 9 during printing.

The printer controller 7 is a control unit for performing control of the printer. The printer controller 7 has an interface unit 24, a CPU 25 and a memory 26. The interface unit 24 performs receiving and transmitting data between the computer CP that is the external apparatus and the printer 1. The CPU 25 is an operation processor for performing control of the entire printer. The memory 26 is for securing an area that stores a program of the CPU 25, an area for working or the like and has a storage device such as a RAM, a ROM, and a NVRAM. The CPU 25 controls each of the units according to the program that is stored on the memory 26. In addition, the printer controller 7 generates dot formation data SI that illustrates where the dot is formed and what size of the dot is formed on the recording medium 9 based on the printing data from the computer CP. The printer controller 7 transmits the dot formation data SI to the head controller 11. Thus, the head controller 11 generates the selection data that select each of the drive pulses that is included in the drive signals COM1 and COM2, and apply to the piezoelectric vibrator 32 based on the dot formation data SI from the printer controller 7. Accordingly, the printer controller 7 and the head controller 11 are functioned as selection control units in the invention. In addition, detailed description of the selection data will be given below.

As shown in FIG. 2, the carriage 12 is attached in a shaft supported state to a guide rod 19 that is suspended in the main scanning direction. The carriage 12 is configured so as to reciprocate in the main scanning direction that is orthogonal to the transportation direction of the recording medium 9 along the guide rod 19 by the operation of the carriage moving mechanism 3. A linear encoder 20 detects a position of the carriage 12 in the main scanning direction and the detected signal, in other words, an encoder pulse (a type of positional information) is transmitted to the CPU 25 of the printer controller 7. The linear encoder 20 is a type of positional information output unit and outputs an encoder pulse corresponding to a scanning position of the recording head 8 as the positional information in the main scanning direction. Accordingly, the printer controller 7 is capable of controlling the recording operation of the recording head 8 while perceiving the scanning position of the carriage 12 (the recording head 8) based on an encoder pulse EP from the linear encoder 20. Thus, in the printer 1, characters, images or the like is recorded on a recording paper S in both directions during forward movement in which the carriage 12 moves toward an opposed end portion (a full position) from a home position and during backward movement in which the carriage 12 returns to the home position from the full position.

The encoder pulse EP from the linear encoder 20 is input to the printer controller 7. The printer controller 7 generates a timing pulse PTS (Print Timing Signal) from the encoder pulse EP and performs transmittance of the printing data, generation of the drive signal COM or the like in synchronization with the timing pulse PTS. Thus, the drive signal generating circuit 4 outputs the drive signal COM in a timing based on the timing pulse PTS. In addition, the printer controller 7 generates and outputs a timing signal such as a latch signal LAT to the recording head 8 based on the timing pulse PTS. The latch signal LAT is a signal that defines a start timing of a recording period. Accordingly, the unit period of the drive signal COM is a section that is divided by the latch signal LAT.

Figure 3:
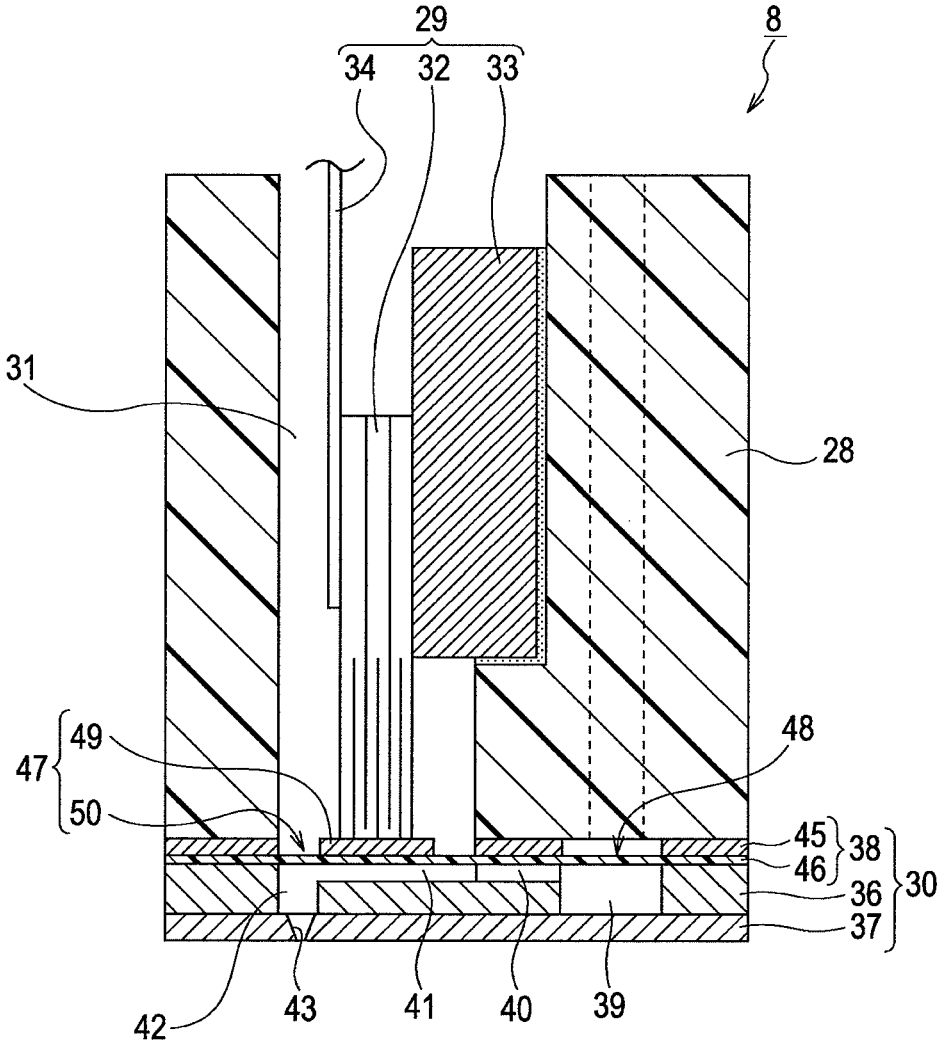
FIG. 3 is a cross-sectional view of a main portion of a recording head.

Next, the configuration of the recording head 8 will be described with reference to FIG. 3.

The recording head 8 includes a case 28, a vibrator unit 29 that is accommodated in the case 28 and a flow passage unit 30 that is connected to a bottom surface (a front end surface) of the case 28. The case 28 is, for example, made from epoxy resin and forms an accommodating space 31 for accommodating the vibrator unit 29 inside thereof. The vibrator unit 29 includes a piezoelectric vibrator 32 that functions as a type of pressure generating unit, a fixing plate 33 where the piezoelectric vibrator 32 is connected and a flexible cable 34 for supplying the drive signal or the like to the piezoelectric vibrator 32. The piezoelectric vibrator 32 is a laminating type that is made by dividing a piezoelectric plate in a comb-shape, where a piezoelectric layer and an electrode layer are laminated alternatively. In addition, the piezoelectric vibrator 32 is of a longitudinal vibration mode that is retractile in a direction orthogonal to a laminating direction (an electric field direction).

The flow passage unit 30 is configured such that a nozzle plate 37 is connected to one surface of a flow passage substrate 36 and a vibration plate 38 is connected to the other surface of the flow passage substrate 36 respectively. A reservoir 39 (also referred to as a common liquid chamber or a manifold), an ink supply port 40, a pressure chamber 41, a nozzle communication port 42 and the nozzle 43 are provided at the flow passage unit 30. Thus, a series of ink flow passages from the ink supply port 40 to the nozzle 43 through the pressure chamber 41 and the nozzle communication port 42 is formed corresponding to each of the nozzles 43.

Figure 4A:
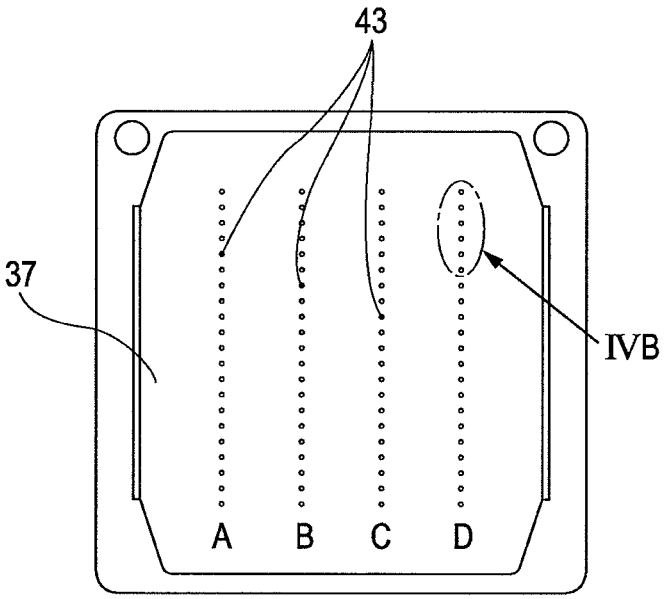
FIGS. 4A and 4B are plan views illustrating configuration of a nozzle plate.
Figure 4B:
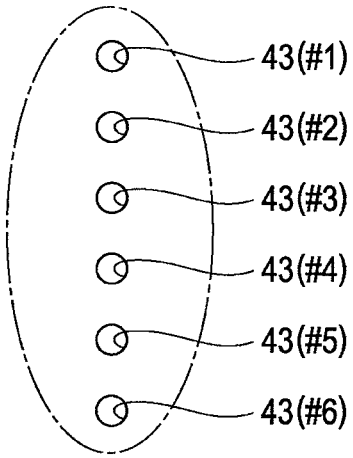

FIGS. 4A and 4B are a drawing illustrating a configuration of the nozzle plate 37. FIG. 4A is a plan view of the nozzle plate 37 and FIG. 4B is an enlarged view of an area IVB in FIG. 4A. In the same drawing, a lateral direction is the main scanning direction (a relative movement direction) where the recording head 8 moves with respect to the recording medium 9 and a longitudinal direction is the transportation direction of the recording medium 9, in other words, is a sub-scanning direction. That is, the main scanning direction and the sub-scanning direction are orthogonal to each other. The nozzle plate 37 is a member where a plurality of (for example, 360) the nozzles 43 is pierced and provided in a linear shape along the sub-scanning direction with a pitch (a gap (about 71 μm) corresponding to, for example, 360 dpi) corresponding to a dot formation density. In the embodiment, the nozzle plate 37 is made of, for example, stainless steel. In addition, the nozzle plate 37 may be made of a silicon single crystal substrate. In the embodiment, four nozzle columns A to D (a type of nozzle group) are lined up at the nozzle plate 37 along the main scanning direction.

The vibration plate 38 is a dual structure where a resilient film 46 is laminated on the surface of a supporting plate 45. In the embodiment, the supporting plate 45 is made of a stainless steel plate that is a type of metal plate. The vibration plate 38 is made using a complex plate material where resin film is laminated on the surface of the supporting plate 45 as the resilient film 46. A diaphragm portion 47 that varies a volume of the pressure chamber 41 is provided at the vibration plate 38. In addition, a compliance portion 48 that seals a portion of the reservoir 39 is provided at the vibration plate 38.

The above-described diaphragm portion 47 is made by partially removing the supporting plate 45 by an etching process or the like. In other words, the diaphragm portion 47 has an island portion 49 to which a front end surface of a free end of the piezoelectric vibrator 32 is bonded and a thin resilient portion 50 that surrounds the island portion 49. The above-described compliance portion 48 is made by removing the supporting plate 45 of an area opposed to an opening surface of the reservoir 39 by the etching process or the like similar to the diaphragm portion 47. In addition, the compliance portion 48 has a function as a damper that absorbs pressure variation of liquid reserved in the reservoir 39.

Accordingly, the front end surface of the piezoelectric vibrator 32 is bonded to the above-described island portion 49 so that the free end of the piezoelectric vibrator 32 is retractile, and then the volume of the pressure chamber 41 may be varied. The pressure variation is generated in ink inside the pressure chamber 41 according to the volume variation. Thus, the recording head 8 ejects ink droplet from the nozzles 43 using the pressure variation.

FIG. 5 is a waveform drawing illustrating a configuration of the first drive signal COM1 and the second drive signal COM2 that are generated by the drive signal generating circuit 4 of the embodiment. Here, the unit period T that is a repeat period of the drive signal corresponds to a time in which the nozzle 43 moves in a distance equivalent to a width of a pixel that is a configuration unit of the image when the recording head 8 ejects ink while relatively moving with respect to the recording medium 9.

In the embodiment, the unit period T is divided into two periods, specifically divided into a period T1 and a period T2. Thus, the first drive signal COM1 includes a first middle dot drive pulse P1*a* (a type of the first drive pulse in the invention) that is generated at the period T1 and a first small dot drive pulse P1*b* (a type of a first drive pulse in the invention) that is generated at the period T2. Similarly, the second drive signal COM2 includes a second middle dot drive pulse P2*a* (a type of a second drive pulse in the invention) that is generated at the period T1 and a second small dot drive pulse P2*b* (a type of the second drive pulse in the invention) that is generated at the period T2. The middle dot drive pulses P1*a* and P2*a* are, for example, drive pulses for ejecting ink droplet of tens of p1 and the small dot drive pulses P1*b* and P2*b* are, for example, drive pulses for ejecting ink droplet of ones units of p1. It is desirable that the weight of the ink droplet of the middle dot drive pulse be heavier than that of the small dot drive pulse relatively. The middle dot drive pulse and the small dot drive pulse are not limited to the weight of the above-described ink droplet. The second middle dot drive pulse P2*a* of the second drive signal COM2 at the period T1 is generated slightly later than the first middle dot drive pulse P1*a* of the first drive signal COM1 at the period T1. Similarly, the second small dot drive pulse P2*b* of the second drive signal COM2 at the period T2 is generated slightly later than the first small dot drive pulse P1*b* of the first drive signal COM1 at the period T2. Detailed description thereof will be given below.

Figure 6:
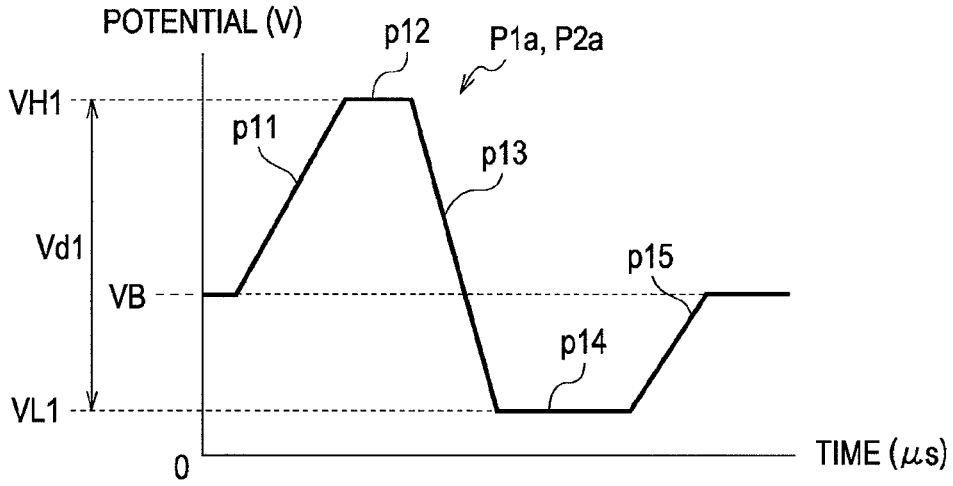
FIG. 6 is a waveform drawing illustrating a configuration of a middle dot drive pulse.

FIG. 6 is a waveform drawing illustrating a configuration of the middle dot drive pulses P1*a* and P2*a*.

The volume of a pressure chamber will be described with using terms of "expansion" and "contraction" below. "Expansion" means a state in which the volume varies to a large volume when the subsequent waveform element is applied with respect to the pressure chamber that has a predetermined volume by the waveform element that is applied just before. "Contraction" means a state in which the volume varies to a small volume when the subsequent waveform element is applied with respect to the pressure chamber that has a predetermined volume by the waveform element that is applied just before. In addition, "hold" means that the state of the pressure chamber does not vary, which has a predetermined volume by the waveform element that is applied just before.

As shown in FIG. 6, the middle dot drive pulses P1*a* and P2*a* are configured of a preliminary portion p11 (a type of expansion element in the invention), a hold portion p12, a contraction portion p13, a hold portion p14 (a type of contraction element in the invention) and a return portion p15. The preliminary portion p11 is a waveform element where the potential varies in a constant slope to the plus (a first polarity) side from a reference potential VB (a middle potential) to a first highest potential VH1, in other words, is a waveform element where the potential varies higher than the reference potential VB. The hold portion p12 is a waveform element where the potential is constant at the first highest potential VH1 that is a final potential of the preliminary portion p11. In addition, the contraction portion p13 is a waveform element where the potential varies in a constant slope to the negative (a second polarity) side from the first highest potential VH1 to a first lowest potential VL1, in other words, is a waveform element where the potential varies lower than the reference potential VB. The hold portion p14 is a waveform element where the potential is constant at the first lowest potential VL1. The return portion p15 is a waveform element that returns the potential from the first lowest potential VL1 to the reference potential VB.

When the middle dot drive pulses P1*a* and P2*a* that are configured as described above are applied to the piezoelectric vibrator 32, first of all, the piezoelectric vibrator 32 is contracted by the preliminary portion p11. The pressure chamber 41 expands from the reference volume that corresponds to the reference potential VB to a volume that corresponds to the first highest potential VH1 according to the contraction of the piezoelectric vibrator 32. According to the expansion, a meniscus is largely drawn into the pressure chamber 41 side at the nozzle 43 and ink is supplied into the pressure chamber 41 through the ink supply port 40 from the reservoir 39 side. Thus, the expansion state of the pressure chamber 41 is maintained according to the supply of the hold portion p12.

After the expansion state is maintained by the hold portion p12, the contraction portion p13 is applied to the piezoelectric vibrator 32 so that the piezoelectric vibrator 32 expands. The pressure chamber 41 that is expanded according to the expansion of the piezoelectric vibrator 32, rapidly contracts to a volume that corresponds to the first lowest potential VL1. Accordingly, ink inside the pressure chamber 41 is pressurized, the center portion of the meniscus at the nozzle 43 is drawn out to the ejection side and the drawn out portion extends as a liquid column. Continuously, the contraction state of the pressure chamber 41 is maintained in a constant time by the hold portion p14. The meniscus and the liquid column are separated during this time, and the separated portion is ejected from the nozzle 43 as an ink droplet corresponding to the middle dot so as to fly toward the recording medium 9. The return portion p15 is applied to the piezoelectric vibrator 32 in accordance with the timing when the ink pressure inside the pressure chamber 41, which is decreased by the ink ejection, is increased again. Since the pressure chamber 41 expands according to application of the return portion p15, the pressure chamber 41 returns to the normal volume and the pressure variation (residual vibration) of ink inside the pressure chamber 41 is suppressed.

Figure 7:
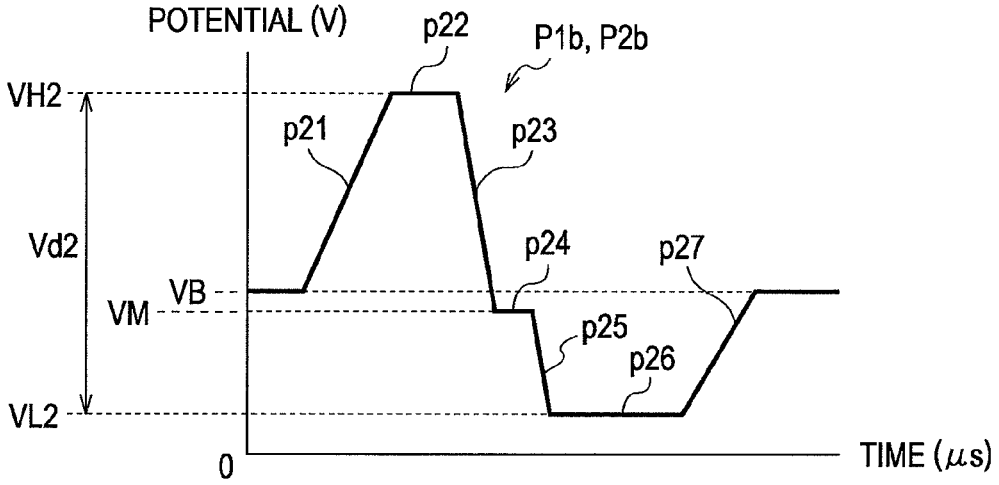
FIG. 7 is a waveform drawing illustrating a configuration of a small dot drive pulse.

FIG. 7 is a waveform drawing illustrating a configuration of the small dot drive pulses P1*b* and P2*b*.

As shown in the same drawing, the small dot drive pulses P1*b* and P2*b* are configured of a preliminary portion p21 (a type of expansion element in the invention), a hold portion p22 (a holding element), a first contraction portion p23 (a type of contraction element in the invention), a middle hold portion p24, a second contraction portion p25, a hold portion p26 and a return portion p27. The preliminary portion p21 is a waveform element where the potential changes in a constant slope to the positive side from the reference potential VB to the second highest potential VH2, in other words, the preliminary portion is a waveform element where the potential changes toward a potential higher than the reference potential VB. The hold portion p22 is a waveform element where the potential is constant at the second highest potential VH2 that is final potential of the preliminary portion p21. In addition, the first contraction portion p23 is a waveform element where the potential changes in a constant slope to the minus side from the second highest potential VH2 to the middle potential VM of which the potential is set to lower than the reference potential VB, in other words, the first contraction portion is a waveform element where the potential changes toward a potential lower than the reference potential VB. The middle hold portion p24 is a waveform element where the potential is constant at the middle potential VM. Furthermore, the second contraction portion p25 is a waveform element where the potential varies (descends) in a constant slope to the minus side from the middle potential VM to the second lowest potential VL2. The hold portion p26 is a waveform element where the potential is constant at the second lowest potential VL2. The return portion p27 is a waveform element where the potential returns from the second lowest potential VL2 to the reference potential VB.

When the small dot drive pulses P1*b* and P2*b* that are configured as described above are applied to the piezoelectric vibrator 32, first of all, the piezoelectric vibrator 32 is contracted by the preliminary portion p21. According to the contraction, the pressure chamber 41 expands from the reference volume that corresponds to the reference potential VB to a volume that corresponds to the second highest potential VH2 (a first change process). According to the expansion, the meniscus is largely drawn into the pressure chamber 41 side at the nozzle 43 and ink inside the pressure chamber 41 is supplied through the ink supply port 40 from the reservoir 39 side. The potential of the preliminary portion p21 varies in a steeper slope than the slope of the preliminary portion p11 of the first ejecting drive pulse such that the meniscus is drawn in further rapidly. Here, while the center portion of the meniscus that is positioned far away from an inner periphery surface of the nozzle is moves at further high speed following the pressure change, a moving speed of the inner periphery surface (a boundary layer) that is nearer than the center portion is slower than that of the center portion because the viscosity of the portion has an effect and is difficult for the portion to follow the pressure change. Accordingly, in a case of the first ejecting drive pulse, the entire meniscus is largely drawn in by the preliminary portion p11, and in a case of the second ejecting drive pulse, mainly the center portion of the meniscus tends to be largely drawn in by the preliminary portion p21. Thus, the liquid column described below may be small. The expansion state of the pressure chamber 41 is maintained and synchronized with a supply period of the hold portion p22 (a hold process).

After the expansion state is maintained by the hold portion p22, the first contraction portion p23 is applied to the piezoelectric vibrator 32 so that the piezoelectric vibrator 32 expands. The pressure chamber 41 that expands according to the expansion of the piezoelectric vibrator 32 contracts (a second change process) to the middle volume that corresponds to the middle potential VM. Accordingly, ink inside the pressure chamber 41 is pressurized, the center portion of the meniscus is drawn out to the ejection side at the nozzle 43 and the drawn out portion extends like the liquid column. Continuously, the hold portion p24 is supplied and the volume of the pressure chamber that is varied by the second change process is maintained only for a negligible amount of time (a maintenance process). The maintenance process stops the extension of the piezoelectric vibrator 32 temporally. During this time, ink inside the pressure chamber 41 is not pressurized such that the extension of the liquid column is suppressed by that amount. Accordingly, in a case of the first ejecting drive pulse, in other words, the size of the liquid column becomes smaller than a case where the pressure chamber 41 contracts at once to the contraction volume without stopping along the way.

After the hold portion p24 is held, the second contraction portion p25 further rapidly expands the piezoelectric vibrator 32 and the pressure chamber 41 is pressurized until the pressure chamber 41 is further contracted from the state where the volume change is suppressed by the hold portion p24 (a third change process). Accordingly, the entire meniscus is rapidly drawn out in the ejection direction and a rear end portion of the liquid column is accelerated. Thus, the meniscus and the liquid column are separated and the separated portion is ejected from the nozzle 43 as the ink droplet corresponding to the small dot and flies toward the recording medium 9. After the second contraction portion p25, the contraction state of the pressure chamber 41 is maintained for a constant time by the third change process by the hold portion p26. The return portion p27 is applied to the piezoelectric vibrator 32 according to timing where the pressure of ink inside the pressure chamber 41 that is decreased by the ejection of ink, increases again. According to application of the return portion p27, the pressure chamber 41 expands until it returns to the volume that is just before the preliminary portion p21 is applied.

Next, in the above-described printer 1, a configuration for ejecting high viscosity ink such as photo-curable ink (a type of high viscosity liquid) will be described.

Here, in the above-described printer 1, since the nozzles 43 are arranged with high density of 300 dpi or more, a partition that divides the pressure chambers 41 that are adjacent to each other is thin. Thus, for example, at the nozzle 43 (the ejecting nozzle) that performs ejection of ink at any timing, states of the pressure variation that is generated inside the pressure chamber 41 are different between when the ejection of ink is simultaneously performed at both of the adjacent nozzles 43 of the ejecting nozzles and when the ejection of ink is not performed at both of the adjacent nozzles 43 (when ink is separately ejected) such that there is a concern that the ejecting characteristic in the ejecting nozzle will be varied. Specifically, if high viscosity ink of which viscosity when ink is ejected from the nozzle 43 is 8 mPa·s or more at room temperature (for example, 25° C.) is ejected, for example, the above-described photo-curable ink is ejected, crosstalk tends to be easily generated.

Accordingly, when ink is ejected from each of the nozzles 43 within the same unit period, the printer of the invention displaces the timing between adjacent nozzles 43, when the pressure of ink inside the pressure chamber 41 is the highest between adjacent nozzles 43 such that the above-described crosstalk is suppressed.

Specifically, regarding the first middle dot drive pulse P1*a* of the first drive signal COM1 and the second middle dot drive pulse P2*a* of the second drive signal COM2 at the same unit period T1 and regarding a time Δt1 from a start end of the contraction portion p13 of the first middle dot drive pulse P1*a* to the start end of the contraction portion p13 of the second middle dot drive pulse P2*a*, when a Helmholtz period (inherent vibration period) that is generated in ink inside the pressure chamber 41 is Tc, Tc/2≤Δt1≤Tc is set. In addition, above-described Tc may be generally present as a formula (1) below.

$$Tc=2\pi\sqrt{[(Mn+Ms)/(Mn\times Ms\times(Cc+Ci))]} \quad (1)$$

In the above-described formula (1), Mn is an inertance (a mass of ink per unit cross-sectional area) at the nozzle 43, Ms is an inertance at the ink supply port 40, Cc is a compliance (a volume change per unit pressure, illustrating tenderness degree) of the pressure chamber 41 and Ci is a compliance (Ci=volume V/[density ρ×sound velocity $c^2$]) of ink.

In the embodiment, as shown in FIG. 4B, a serial number (for example, #1 to #360) with respect to each of the nozzles 43 that configure the same nozzle column is virtually added. For example, the first drive signal COM1 is used at the ejection of ink from the nozzle 43 of the odd number while the second drive signal COM2 is used at the ejection of ink from the nozzle 43 of the even number. In addition, correspondence relation between the drive signals COM1 and COM2 with respect to the nozzles of the odd number and the nozzles of the even number may be inverted. The nozzles 43 of the odd number and the even number that are sequent are adjacent to each other so that ink is ejected by different drive signal respectively between the adjacent nozzles 43. In other words, when ink corresponding to the middle dot is ejected from the nozzles 43 of the odd number, the first middle dot drive pulse P1*a* of the first drive signal COM1 is selected so as to be applied to the piezoelectric vibrator 32 corresponding to the nozzles 43 of the odd number. When ink corresponding to the middle dot is ejected from the nozzles 43 of the even number, the second middle dot drive pulse P2*a* of the second drive signal COM2 is selected so as to be applied to the piezoelectric vibrator 32 corresponding to the nozzles 43 of the even number.

Here, a pressure inside the pressure chamber 41 is the highest at a timing (in other words, near of end of the contraction portion p13) when the contraction portion p13 is applied to the piezoelectric vibrator 32 and the volume of the pressure chamber 41 is contracted so as to eject ink from the nozzle 43 communicating with the pressure chamber 41. Accordingly, ink is ejected using the first middle dot drive pulse P1*a* with respect to the nozzle 43 of one side of the adjacent nozzles 43 and ink is ejected using the second middle dot drive pulse P2*a* with respect to the nozzle 43 of the other side of the adjacent nozzles 43 so that the timing when the pressure of ink inside the pressure chamber 41 is the highest is displaced by each other. In other words, in the case of Tc/2≤Δt1, after the peak of the pressure variation at the nozzle 43 of one side according to the contraction portion p13 of the first middle dot drive pulse P1*a* is passed over, the ejection of ink at the nozzle 43 of the other side according to the second middle dot drive pulse P2*a* is performed. Accordingly, regardless of the number of the nozzles 43 that are driven at the same unit period T, ink is ejected from each of the nozzles 43 in a state near the state where ink is always ejected independently so that variation of the ejecting characteristic is suppressed. As a result, crosstalk between the adjacent nozzles may be decreased. In addition, Δt1 is Tc or less and then that the landing position of ink on the recording medium, which is ejected from each of the nozzles 43 at the same nozzle column (in other words, the nozzle column where ink of the same color is assigned) is significantly displaced is decreased. As a result, deterioration of image quality caused by displacement of landing position of the recording image or the like is suppressed. Furthermore, Δt1 is Tc or less and then that the unit period T is unnecessarily long is decreased. Accordingly, the speed of the printing process is prevented from decreasing and it may contribute to high frequency driving.

In addition, regarding the first small dot drive pulse P1*b* of the first drive signal COM1 and the second small dot drive pulse P2*b* of the second drive signal COM2 at the same unit period T1, a timing when the pressure inside the pressure chamber 41 is the highest compared to the middle dot drive pulses P1*a* and P2*a* is not obvious. Thus, a time Δt2 from a start end (a start end of the preliminary portion p21) of the first small dot drive pulse P1*b* to a start end (a start end of the preliminary portion p21) of the second small dot drive pulse P2*b* is set to Tc or more (Δt2≥Tc). As described above, between the drive pulses where the timing at which the pressure inside the pressure chamber 41 is the highest is not obvious, when Δt2 is Tc or more, the timing at which the pressure inside the pressure chamber 41 is the highest may be displaced between the adjacent nozzles. In addition, reduction of the vibration of high viscosity ink itself is faster than that of low viscosity liquid (less than 8 mPa·s) so that crosstalk may be certainly decreased. In addition, the period of the vibration of high viscosity ink and low viscosity ink is not varied presupposing the same flow passage. However, when the pressure with the same magnitude is added at the same timing, amplitude of the vibration of high viscosity ink is smaller than that of low viscosity ink when a predetermined time has lapsed.

In addition, the invention is not limited to each of the above-described embodiments and various modifications may be performed based on the description of claims.

For example, in the above-described embodiments, the drive pulses of the invention are illustrated in FIGS. 5 and 6, however the shape and the number of the drive pulses, or arrangement of each of ejecting drive pulses in the drive signal are not limited to the embodiments.

In addition, in the above-described embodiment, the first drive pulse and the second drive pulse of the invention are illustrated as the configuration of the same waveform, however the invention may also be applied to the waveforms of the first drive pulse and the second drive pulse that are different to each other. Further, in this case, if the waveform where the above-described preliminary portion or the contraction portion is present is premised at the waveforms of the first drive pulse and the second drive pulse, when the timing when the pressure inside the pressure chamber is the highest may be obvious, it is desirable that the time Δt1 between the start ends of the contraction portion p13 of both pulses be set to Tc/2≤Δt1≤Tc. In addition, when the timing when the pressure inside the pressure chamber is the highest is not obvious, it is desirable that the time Δt2 between the start ends of the preliminary portion of both pulses be set to Tc or more.

In addition, in the above-described embodiments, as the pressure generating unit, the piezoelectric vibrator 32 of a so-called vertical vibration type is illustrated, however, the invention is not limited to this configuration. For example, the invention may employ a piezoelectric element of a so-called flexible vibration type. In this case, regarding the drive pulse P illustrated in the above-described embodiments, it is the waveform that is reversed in the variation direction of the potential, in other words, the upper and lower direction thereof.

In addition, the pressure generating unit is not limited to the piezoelectric element and the invention may also be applied to cases of various pressure generating units such as a static actuator that varies the volume of the pressure chamber using a heat generating element that generates air bubbles inside the pressure chamber or an electrostatic force and the like.

Accordingly, in the above description, the ink jet type printer 1 that is a type of the liquid ejecting apparatus is exemplified, however, the invention may be applied to a liquid ejecting apparatus that performs ejection of liquid using the drive pulse. For example, the invention may be applied to a display manufacturing apparatus that manufactures a color filter of a liquid crystal display or the like, an electrode manufacturing apparatus that forms electrode of an organic EL (Electro Luminescence) display, a FED (field emission display) or the like, a chip manufacturing apparatus that manufactures biochips (biochemical elements), and a micro pipette that supplies an exact amount of test solution of an extremely small amount.

The entire disclosure of Japanese Patent Application No. 2011-062828, filed Mar. 22, 2011 is incorporated by reference herein.

What is claimed is:

1. A liquid ejecting apparatus comprising:

a liquid ejecting head that has a plurality of nozzles ejecting liquid, a pressure chamber communicating with each of the nozzles respectively and a pressure generating unit generating a pressure variation to liquid inside the pressure chamber, and that ejects liquid from the nozzle by driving of the pressure generating unit;

a drive signal generating unit that is capable of generating a plurality of drive signals including drive pulses that drive the pressure generating unit so as to eject liquid, in a predetermined period; and a selection control unit that performs control to selectively apply the drive pulses included in the drive signals that are generated from the drive signal generating unit with respect to the pressure generating unit, wherein the drive signal generating unit generates a first drive signal including a first drive pulse and a second drive signal including a second drive pulse that is generated later than the first drive pulse within the same period, wherein an inherent vibration period of pressure vibration that is generated in liquid inside the pressure chamber is Tc;

wherein a period of the first drive pulse is T;

wherein the second drive pulse starts at a time $\Delta t$ after the first drive pulse starts;

wherein $Tc \leq \Delta t \leq T$, such that the second drive pulse begins after the first drive pulse begins but before the first drive pulse ends; and wherein the selection control unit applies the first drive pulse with respect to the pressure generating unit corresponding to one side of adjacent nozzles and applies the second drive pulse with respect to the pressure generating unit corresponding to the other side thereof.

2. The liquid ejecting apparatus according to claim 1, wherein a viscosity of liquid is 8 mPa·s or more when liquid is ejected from the nozzle.

3. The liquid ejecting apparatus according to claim 1, wherein a formation pitch of each of the nozzles is 1/300 inch or less.

4. A liquid ejecting apparatus comprising:

a liquid ejecting head that has a plurality of nozzles ejecting liquid, a pressure chamber communicating with each of the nozzles respectively and a pressure generating unit generating a pressure variation to liquid inside the pressure chamber, and that ejects liquid from the nozzle by driving of the pressure generating unit;

a drive signal generating unit that is capable of generating a plurality of drive signals including drive pulses that drive the pressure generating unit so as to eject liquid, in a predetermined period, the plurality of drive signals; and a selection control unit that performs control to selectively apply the drive pulses included in the drive signals that are generated from the drive signal generating unit with respect to the pressure generating unit, wherein the drive signal generating unit generates a first drive signal including a first drive pulse and a second drive signal including a second drive pulse that is generated later than the first drive pulse within the same period, wherein the first drive pulse and the second drive pulse have an expansion element that preliminarily expands the pressure chamber and a contraction element that contracts the pressure chamber expanded by the expansion element respectively so as to eject liquid from the nozzle, wherein an inherent vibration period of pressure vibration that is generated in liquid inside the pressure chamber is Tc;

wherein a time from a start end of the contraction element of the first drive pulse to a start end of the contraction element of the second drive pulse is $\Delta t$;

wherein $Tc/2 \leq \Delta t \leq Tc$, and wherein the selection control unit applies the first drive pulse with respect to the pressure generating unit corresponding to one side of adjacent nozzles and applies the second drive pulse with respect to the pressure generating unit corresponding to the other side thereof.

5. The liquid ejecting apparatus according to claim 4, wherein a period of the first drive pulse is T, wherein $\Delta t < T$ such that the second drive pulse begins after the first drive pulse begins but before the first drive pulse ends.

* * * * *